US005079936A

United States Patent [19]

Stefanek

[11] Patent Number: 5,079,936

[45] Date of Patent: Jan. 14, 1992

[54] HIGH SECURITY CYLINDER LOCK

[75] Inventor: Ronald T. Stefanek, Lockport, Ill.

[73] Assignee: Folger Adam Company, Lemont, Ill.

[21] Appl. No.: 616,696

[22] Filed: Nov. 20, 1990

Related U.S. Application Data

[63] Continuation of Ser. No. 332,519, Mar. 31, 1989, abandoned.

[51] Int. Cl.[5] ..... E05B 27/00

[52] U.S. Cl. ..... 70/358; 70/419; 70/493; 70/409; 70/367

[58] Field of Search ..... 70/358, 367–369, 70/381, 386, 406, 407, 409, 419, 492, 493, 421

[56] References Cited

U.S. PATENT DOCUMENTS

| | | | |
|---|---|---|---|
| Re. 39,910 | 6/1985 | Oliver | 70/369 |
| 758,026 | 4/1904 | Taylor . | |
| 1,965,889 | 7/1934 | Fitzgerald | 70/419 |
| 3,181,320 | 5/1965 | Bauer | 70/421 |
| 3,393,542 | 7/1968 | Crepinsek | 70/358 |
| 3,455,130 | 7/1969 | Basseches | 70/421 |
| 3,499,302 | 3/1970 | Spain et al. | 70/364 |
| 3,667,264 | 6/1972 | Surko, Jr. et al. | 70/369 |
| 3,713,310 | 1/1973 | Surko, Jr. | 70/364 A |
| 3,722,240 | 3/1973 | Spain et al. | 70/364 |
| 3,802,234 | 4/1974 | Gerlach | 70/421 |
| 3,837,197 | 9/1974 | Lopez | 70/364 A |
| 3,857,263 | 12/1974 | Gartner | 70/493 |
| 4,078,406 | 3/1978 | Genakis | 70/419 X |
| 4,185,480 | 1/1980 | Pechner | 70/358 |
| 4,194,604 | 4/1980 | Vorob . | |
| 4,208,894 | 6/1980 | Surko, Jr. | 70/364 A |
| 4,250,725 | 2/1981 | Prunbauer | 70/358 X |
| 4,343,166 | 8/1982 | Hofmann | 70/358 |
| 4,356,713 | 11/1982 | Widen | 70/364 A |
| 4,377,082 | 3/1983 | Wolter | 70/364 A |
| 4,380,163 | 4/1983 | Reder | 70/364 A |
| 4,393,673 | 7/1983 | Widen | 70/358 |
| 4,404,824 | 9/1983 | Hennessy | 70/364 A |
| 4,429,554 | 2/1984 | Litvin | 70/358 |
| 4,434,636 | 3/1984 | Prunbauer | 70/358 |
| 4,453,432 | 6/1984 | Widen | 76/110 |
| 4,524,593 | 6/1985 | Hennessy | 70/358 |
| 4,631,941 | 12/1986 | Sjunnesson | 70/358 X |
| 4,635,455 | 1/1987 | Oliver | 70/364 A |
| 4,638,651 | 1/1987 | Surko, Jr. | 70/364 A |
| 4,712,399 | 12/1987 | Mattossovich | 70/419 X |
| 4,732,022 | 3/1988 | Oliver | 70/406 |

FOREIGN PATENT DOCUMENTS

| | | | |
|---|---|---|---|
| 73832 | 2/1952 | Denmark . | |
| 161654 | 11/1985 | European Pat. Off. | 70/493 |
| 0202949 | 11/1986 | European Pat. Off. . | |
| 0237172 | 9/1987 | European Pat. Off. . | |
| 237799 | 9/1987 | European Pat. Off. | 70/493 |
| 2003059 | 7/1971 | Fed. Rep. of Germany . | |
| 2351310 | 5/1979 | Fed. Rep. of Germany . | |
| 3410462 | 9/1985 | Fed. Rep. of Germany | 70/358 |
| 1408340 | 11/1975 | United Kingdom . | |
| 2055948A | 3/1981 | United Kingdom . | |

*Primary Examiner*—Gary L. Smith
*Assistant Examiner*—Suzanne L. Dino
*Attorney, Agent, or Firm*—Willian Brinks Olds Hofer Gilson & Lione

[57] ABSTRACT

A cylinder lock is provided which comprises a cylindrical housing; a core which is rotatably mounted in the housing, thereby defining a shear line; a first tumbler slidably disposed in a first aperture; means for moving the first tumbler between a locked and an unlocked position; a second tumbler slidably disposed in a second aperture; and means for moving the second tumbler between a locked and an unlocked position. When the lock is in the locked position, the first tumbler extends across the shear line into the first aperture of the core. When a correct key is inserted into the keyway, the first tumbler is urged completely into the core below the shear line. The second tumbler is arranged such that when the lock is in the locked position, the second tumbler extends across the shear line and such that when the correct key is inserted, the second tumbler is urged completely into the housing above the shear line. The first and second tumblers are configured such that the first and second tumblers resist radial movement if a tensioning movement is applied between the core and the housing.

23 Claims, 2 Drawing Sheets

2 2

HIGH SECURITY CYLINDER LOCK

This application is a continuation of application Ser. No. 07/332,519, filed 3/31/89, now abandoned.

BACKGROUND OF THE INVENTION

This invention relates generally to cylinder-type locks having a core, a housing and tumblers which cooperate to define a locking mechanism for the lock. More particularly, the invention relates a high security cylinder lock arrangement which is resistant to conventional lock picking techniques.

Various types of cylinder locks are presently available in the art. Cylinder-type locks are typically comprised of a key plug or core which is rotatably mounted within a cylindrical housing and a locking mechanism which prevents rotation of the core if a correct key is not inserted into the keyway of the lock. The locking mechanisms typically include either tumblers, side bars or a combination of both. Typically, insertion of a key corresponding to the lock (hereinafter "a correct key") raises the tumblers above the shear line which is defined by the outer surface of the core and the inner surface of the housing.

Tumbler type locking mechanisms are typically comprised of a plurality of tumblers, which are reciprocally mounted within aligning bores in the core and housing. The tumblers, which usually comprise cylindrically shaped pins, are typically spring biased across the shear line such that they normally cross the shear line when a correct key is not inserted in the lock. The tumblers thus prevent the core from rotating within the housing when the correct key is not used.

Tumbler locking mechanisms may incorporate tumblers which are each comprised of two separate tumbler parts or segments which have a mating surface at the separation. Each of the tumblers includes a spring biased plug tumbler and a change tumbler. The tumblers are configured such that when the correct key (described in more detail below) is inserted into the keyway, the separation between the plug and change tumblers occurs at the shear line. The plug tumbler is biased radially inwardly into the core such that when the correct key is not inserted into the keyway of the lock, the plug tumbler crosses and blocks the shear line. The tumbler thus prevents the core from rotating in the housing thereby defining a locked position for the lock. When a correct key is inserted into the lock, the key causes the change tumbler to be moved radially outward to a position such that the separation between the plug and the change tumblers occurs at the shear line. This position of the tumblers defines an open or unlocked position for the lock.

The proper or correct key for the lock conventionally includes a plurality of bits or cuts along the top edge of the key, with each of the cuts having a different height. These cuts urge the change tumblers radially outward causing the separation surface of the two tumbler parts to be aligned with the shear line thereby allowing the key plug to be rotated.

These conventional pin tumbler cylinder lock arrangements may be picked by using known lock picking techniques. Typically, in these known techniques, a tool is used to apply pressure to the cylinder core causing relative displacement to occur between the core and the housing. This tensioning movement latches the tumbler pins in the bores of the housing such that they will resist radial movement (movement along the longitudinal axis of the tumblers). That is, when the latching force which results from the tensioning movement exceeds the biasing force of the springs, the tumblers may be moved radially outward and will not be moved back by the spring biasing mechanism. Another tool is then used to raise the cylinder pins across the shear line.

In another lock picking technique, which is commonly referred to as impressioning, a blank key is inserted into the keyway and turned such that an impressioning mark is left to indicate the location of the tumblers. The marks are then used to form a key which will open the lock.

To this end, a number of improved lock arrangements have been developed to help resists these lock picking techniques. These improved lock configurations typically include the use of tumblers arranged in different radial directions, side bars, tumblers with skew-cut bits which cooperate with a skewed cut on the key to rotate the tumblers, and a variety of other configurations.

For example, U.S. Pat. No. 4,434,636 (Prunbauer) discloses a cylinder lock, which in addition to convention pin type tumblers, includes an auxiliary tumbler and a feeler element which cooperate to form an additional locking mechanism. When in the locked position, the upper surface of the auxiliary tumbler engages a cammed arresting recess in the housing to prevent the core from rotating. The feeler element is arranged such that when a correct key is not inserted in the lock, the feeler element urges the auxiliary tumbler outwardly into the arresting recess of the housing. The feeler element includes a recessed section which cooperates with the auxiliary tumbler such that when they are aligned the auxiliary tumbler is permitted to move radially inward. The cammed surface of the housing cams the auxiliary tumbler into the core and out of engagement with the arresting recess when 1) the recessed section of the feeler element is aligned with the auxiliary tumbler and 2) the core is rotated. The feeler element is arranged such that it extends into the keyway. The key includes a recess in one of its sides which cooperates with the feeler element to align the feeler element's recessed section with the auxiliary tumbler.

Another cylinder lock arrangement is disclosed in U.S. Pat. No. 4,723,427 (Oliver). The arrangement disclosed in this patent includes twisting tumblers operated by a bitted key having at least one skew-cut bit. The lock is also provided with a side bar as an additional locking mechanism. The side bar is symmetrically disposed in a plane which passes through the center of the core and which is normal to the plane of the keyway. The cylinder housing includes a slot with a cammed surface which receives the side bar. When in a locked position, the side bar is urged into the slot. The side bar and slot thus cooperate to prevent the core of the lock from rotating.

The side bar includes a plurality of legs which extend into the keyway and abut the outer radial surface of the tumblers when the lock is in the locked position. The side bar is further arranged such that the legs of the side bar intersect not only the outer radial surface of the tumblers but the profile of the key. The tumblers include axial slots which receive the legs of the side bar upon rotation of the tumblers to the correct position. The skew-cut bits in the key function to rotate the tumblers to this correct position. The profile of the key also includes slots which extend normal to its longitudinal axis. When the correct key is inserted into the keyway, the legs of the side bar are aligned with both the slots in the tumblers and the slots in the key thereby allowing the side bar to move radially inward. When the correct key is inserted and the core is rotated, the cammed surface of the slot in the housing urges or cams the side bar radially inward.

Other cylinder lock configurations which include additional sets of tumblers in different radial directions are illustrated in U.S. Pat. Nos. 4,343,166 (Hofmann); 3,802,234 (Gerlach); 3,393,542 (Crepinsek); and 3,181,320 (Bauer).

Although each of the above discussed lock arrangements provides a higher degree of security than is accomplished by using only conventional pin tumblers, they each have unique disadvantages.

For example, if the additional tumblers which are to provide the additional security feature are accessible from the keyway, a person attempting to pick the lock need only use the same techniques to pick the additional tumblers as are used to pick conventional type locks.

In arrangements where (1) an additional tumbler cooperates with a pin-type tumbler to permit the additional tumbler to move into an unlocked position and (2) the additional tumblers include a camming surface which moves them out of the locked position, the person attempting to pick the lock need only to pick the pin-type tumblers and rotate the core to move the lock to the unlocked position. Because of the cammed surface of the additional tumblers, the additional tumblers do not lock the core and housing without the aid of the cooperating pin-type tumblers. Thus, if the cooperating pin-type tumblers are moved to the unlocked position, the additional tumblers will not prevent the core from rotating.

Arrangements using a side bar have the same disadvantages. If the tumblers which hold the side bar in the locked position are moved to the unlocked position, the side bar will not function to prevent the core from rotating because of the cammed surfaces of the side bar and housing.

Further, impressioning techniques may be fairly effective in picking locks which use tumblers that engage only the top edge portion of the key.

Therefore in view of the above, it is a primary object of the present invention to provide a pick resistant high security cylinder lock.

It is a more particular object of the present invention to provide a high security cylinder lock which resists picking by conventional lock picking techniques such as tensioning and impressioning.

It is a further object of the present invention to provide a high security cylinder lock which will remain locked even if the tumblers which are accessible from the keyway are moved to the unlocked position.

It is still a further object of the present invention to provide a pick resist lock which utilizes a key having multiple types of key cuts.

SUMMARY OF THE INVENTION

To achieve the foregoing and other objects and in accordance with the purposes of the present invention, the cylinder lock of the present invention may comprise a cylindrical housing; a core which is rotatably mounted in the housing, thereby defining a shear line between the outer surface of the core and the inner surface of the housing; a first tumbler; means for moving the first tumbler between a locked and an unlocked position: a second tumbler: and means for moving the second tumbler between a locked and an unlocked position. The housing includes a first aperture and a second aperture. The core also includes a first aperture and a second aperture which respectively align with the first and second apertures of the housing when the lock is in the locked position. The first and second tumblers are slidably disposed in the first and second apertures of the core and housing, respectively. When the lock is in the locked position, the first tumbler extends across the shear line into the first apertures of the core and housing. When a correct key is inserted into the keyway, placing the lock in the unlocked position, the first tumbler is urged completely into the core below the shear line. The second tumbler is arranged such that when the lock is in the locked position, the second tumbler extends across the shear line into the second apertures of the core and housing. When the correct key is inserted, the second tumbler is urged completely into the housing above the shear line. The first and second tumblers are configured such that the first and second tumblers resist radial movement if a tensioning movement is applied between the core and the housing.

Thus according to the present invention if a tensioning movement is provided on the core or housing of the cylinder lock, the movement will lock or hold the first and second tumblers across the shear line, thereby preventing rotation of the core. In order to place the lock in the unlocked position, the first tumbler is urged completely into the core in a radially inward direction and the second tumbler is urged completely into the housing in a radially outward direction. Thus, the first and second tumblers can be said move in opposite directions across the shear line. This opposite movement together with the latching configuration of the surfaces of the first and second tumblers provides an arrangement which resists lock picking techniques.

In a particularly advantageous preferred embodiment, the second apertures of the housing and core are disposed such that the second tumbler is not directly accessible from the keyway when the lock is in the locked position. This preferred arrangement provides additional security for the locking mechanism.

Additional objects, advantages and novel features of the invention will be set forth in part in the description which follows, and in part will become apparent to those skilled in the art upon examination of the following or may be learned by practice of the invention. The objects and advantages of the invention may be obtained by means of the combinations particularly pointed out in the appended claims.

DETAILED DESCRIPTION OF THE PRESENTLY PREFERRED EMBODIMENTS

Figure 1:
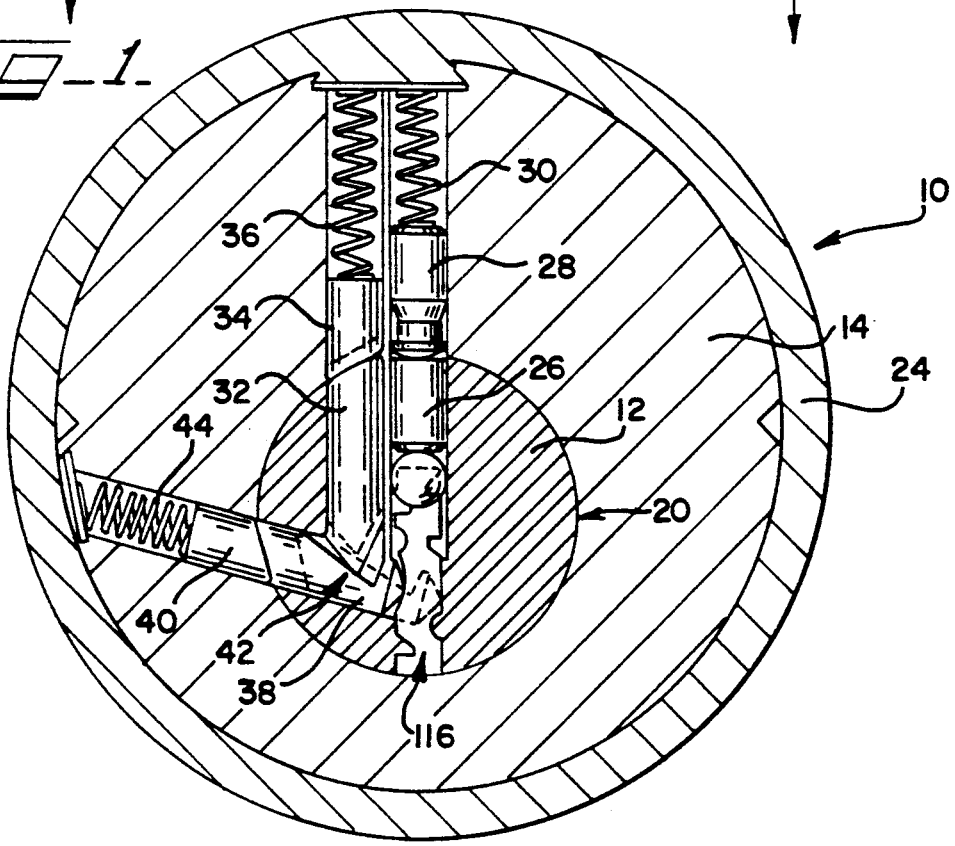
FIG. 1 is a front view of a preferred embodiment of the cylinder lock of the present invention.
Figure 2:
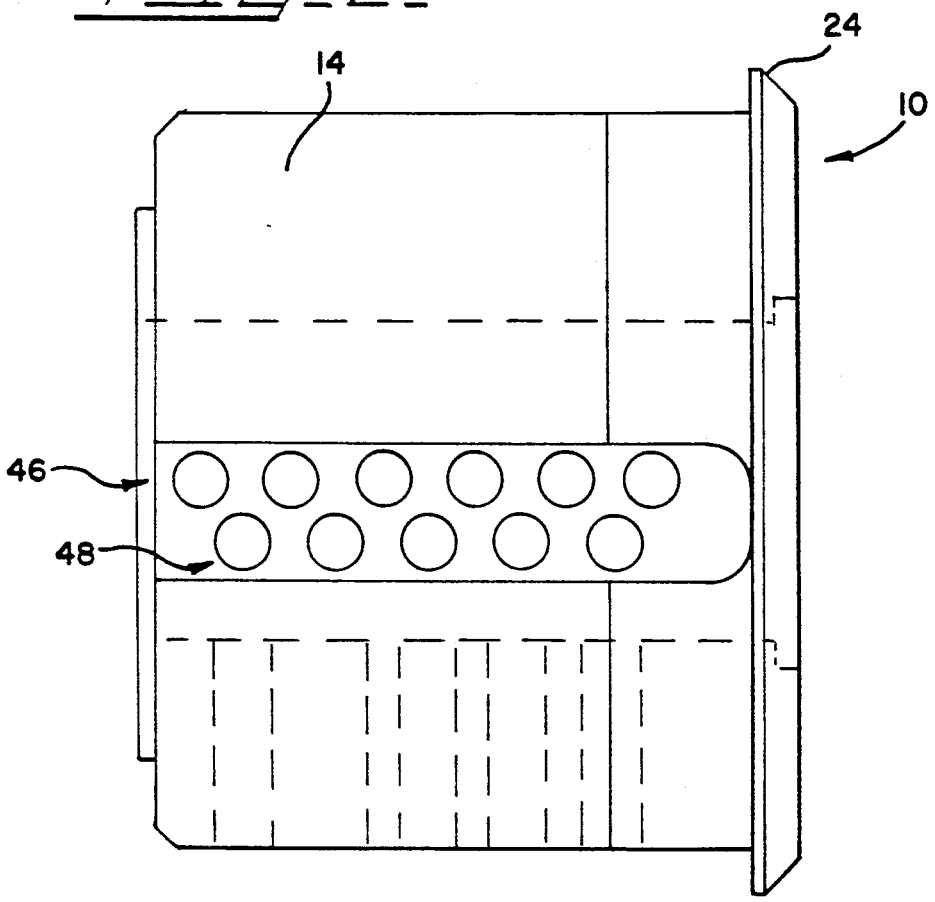
FIG. 2 is a top view through line 2—2 of the cylinder lock illustrated in FIG. 1.

Referring now to the drawings, and particularly to FIGS. 1 and 2, a first preferred embodiment of the cylinder lock of the present invention is illustrated. A cylinder lock 10 includes a cylindrically shaped housing 14 and a cylindrically shaped core section 12 which is rotatably mounted in the housing 14. The outer surface of the core 12 and the inner surface of the housing 14 define shear line 20. The core 12 includes a keyway 16 which is adapted to receive a correct key (described in more detail below) for the specific lock 10. The housing 14 may include a rim or flange section 24, the underside of which abuts against the surface to which the lock 10 is be applied.

As used hereinafter, the lock 10 is defined as being in a locked position when a correct key is not fully inserted into the keyway 16 and the core 12 is not free to rotate within the housing 14. The lock 10 is defined as being in an open or unlocked position when the correct key has been fully inserted into the keyway 16 and the core 12 may freely rotate within the housing 14.

The illustrated embodiment of the lock 10 includes a conventional pin-type tumbler locking mechanism including at least one spring plug tumbler 28 and at least one cooperating change tumbler 26. The two segments of the tumbler are slidably received in an aperture, preferably in the form of a bore, in the core 12 and an aperture, also preferably in the form of a bore, in the housing 14. The bores in the core and housing align when the lock 10 is in the locked position.

A biasing means, preferably a first tumbler spring 30, urges the spring plug tumbler 28 and the change tumbler 26 radially inward. When the lock 10 is in the locked position, the tumbler spring 30 positions the spring plug tumbler 28 and the change tumbler 26 such that the spring plug tumbler 28 crosses and blocks the shear line 20. Thus, the core 12 is prevented from rotating in the housing 14 by the spring plug tumbler 28. When a proper key is inserted, the cuts in the key raise the change tumbler 26 and spring plug tumbler 28 to a position such that the separation surface between these two tumblers is disposed at the shear line thereby not impeding the core 12 from rotating within the housing 14. As will be apparent to those skilled in the art, the cylindrically shaped outer surface of the tumbler 26, 28 and the cylindrically shaped inner surfaces of the bores in the core 12 and housing 14, provide surfaces which are in latching engagement if a tensioning movement is applied between the core 12 and housing 14. That is, when a tensioning movement or force is applied between the core 12 and the housing 14, the spring plug tumbler 28 will resist radial movement. Here the radial movement will be in a direction along the longitudinal axis of the pin-type tumblers in the bores. Since these pin-type tumblers are known in the art, no further details of the bores or tumblers are given here. Although the cylindrical shape of the tumblers and bores is preferred, it will be appreciated that any configuration for the apertures and tumblers which provides the latching feature may be suitable.

To enhance the security feature of the lock 10, the lock 10 includes another tumbler means which preferably comprises a chisel tumbler 32 and means for moving the chisel tumbler 32 such that it crosses the shear line 20 to prevent the core 12 from rotating when the lock 10 is in the locked position. The chisel tumbler 32 is received in another aperture in the core 12, preferably in the form of a bore, and another aperture in the housing 14, also preferably in the form of a bore. These bores in the core 12 and housing 14 also align when the lock 10 is in the locked position.

When the correct key is inserted, the means for moving the chisel tumbler 12 allows the chisel tumbler 32 to be moved completely within the core 12 thereby not impeding the core 12 from rotating in the housing 14.

Means are provided for biasing the chisel tumbler 32 radially inward. Suitable biasing means comprise a second tumbler spring 36 which biases a second spring plug tumbler 34. The second spring plug tumbler 34 includes an engaging surface which mates with the top surface of the chisel tumbler 32. The separating surfaces where the chisel tumbler 32 and spring plug tumbler 34 mate are configured such that when the proper key is inserted and the chisel tumbler 32 is moved radially inward, the shape of the separation surfaces coincides with the shape of the shear line 20.

Suitable means are provided for 1) holding the chisel tumbler 32 across the shear line when the lock 10 is in the locked position, and 2) positioning the chisel tumbler 32 such that it does not impede rotation of the core 12 when the lock 10 is in the unlocked position. A preferred arrangement for the means for positioning the chisel tumbler 32 includes a side tumbler 38 which engages a dimple on the correct key, when the key is inserted into the keyway 16.

As illustrated by the dotted lines in FIG. 1, when the correct key is not inserted into the keyway 16, the side tumbler 38 will extend into the keyway 16. When a proper key is inserted into the keyway, the key moves the side tumbler 38 radially outwardly from the keyway and into the core 12 to a predetermined position. The side tumbler 38 includes an inclined surface 42 which cooperates with the angled surfaces on the lower end of the chisel tumbler 32 to allow the chisel tumbler 32 to move radially inward as the side tumbler 38 is moved radially outward. The angled surface 42 of the side tumbler 38 is configured such that when the correct key is inserted, the tip of the side tumbler 38 cooperates with the dimple in the key to precisely position the side tumbler 38 such that separation surfaces between the chisel tumbler 32 and second spring plug tumbler 34 are aligned with the shear line 20. Thus, when the correct key is used, the chisel tumbler 32 does not impede the core 12 from rotating.

As will be recognized by those skilled in the art, the particular shape and configuration of the chisel tumbler 32 and the side tumbler 38 will depend on the particular shape and size of the lock 10. The tumblers may be suitably machined from a brass material to the desired dimensions.

In an exemplary embodiment the tumbler 38 has a cylindrical configuration with a diameter of approximately 0.156" and includes an angled surface 42 which has an angle of approximately 23° with respect to a plane perpendicular to the longitudinal axis of the tumbler 38. The chisel tumbler similarly is cylindrically shaped with a diameter of approximately 0.156". The angled face of the chiseled tumbler 32 facing away from the keyway has an angle of approximately 35° with respect to a center line plane through the longitudinal axis of the chisel tumbler. The angled face of the chisel tumbler 32 facing toward the keyway with an angle of approximately 25° with respect to the center line plane of the chisel tumbler 32.

As stated above, the radius of curvature of the mating surfaces between the chisel tumbler 32 and the spring plug tumbler 34 and the radius of curvature of the mating surfaces of the side tumbler 38 and the spring plug tumbler 40 as well as the lengths of each of these tumblers will depend on the particular dimensions of the core 12 and the housing 14.

The side tumbler 38 may be disposed at an angle such that the force of gravity moves the tumbler 38 inwardly into the keyway when the proper key is not inserted. In a more preferred embodiment, means are provided for biasing the side tumbler 38 radially inward. Preferably the means include a third tumbler spring 44 and a third driver or spring plug tumbler 40. The third spring plug tumbler 44 is slidably disposed in third bores in the core 12 and the housing 14. In this preferred configuration, when the correct key is not inserted into the keyway 16, the third spring plug tumbler 40 is disposed across the shear line preventing the core 12 from rotating. The third spring plug tumbler 40 and side tumbler 38 are configured such that when the correct key is inserted, the separation surface between the two tumbler sections is aligned with the shear line 20 as not to impede the core 12 from rotating. Preferably the third spring 44 has a greater compression force than the second spring 36.

The chisel tumbler 32 and cooperating side tumbler 38 may be disposed at any angle such that the side tumbler 38 cooperates with a portion of the key to move the side tumbler 38 radially outward. Preferably the chisel tumbler 32 is disposed such that it is parallel to the conventional tumbler segments 26, 28 and is disposed proximate to these conventional tumbler segments. A suitable angle for the bores which receive the side tumbler 38 is 75° with respect to a plane which runs perpendicular to the axis of the chisel tumbler 32.

Preferably the conventional tumbler segments 26, 28 and the chisel tumbler 32 are disposed such that the longitudinal axis of these tumblers is in a plane parallel to the plane which includes the keyway 16 and preferably in a vertical plane. In this configuration, there is no direct axis to the chisel tumbler 32 (or to the bore which receives the chisel tumbler 32) from the keyway 16 when the lock 10 is in the locked position.

As illustrated in FIG. 2, preferably, a plurality of each kind of tumbler are provided for each lock 10. The conventional tumblers may be arranged in a set of bores 46 which are aligned to define a row. Similarly, a plurality of the chisel tumblers 32 and cooperating spring plug tumblers 34 may be disposed in a set of bores 48 which are aligned in a row. Preferably the row of bores 48 is parallel to the row of bores 46. As illustrated, the bores may be arranged such that the bores in the row 46 are interspaced with the bores of the row 48. The spacing between the individual bores in the set will, of course, depend on the particular shape and size of the tumblers which are to be used. For a lock having tumblers with the dimensions of the exemplary embodiment discussed above, the center line to center line distance between each bore in the set 48 is approximately 0.25".

Figure 3:
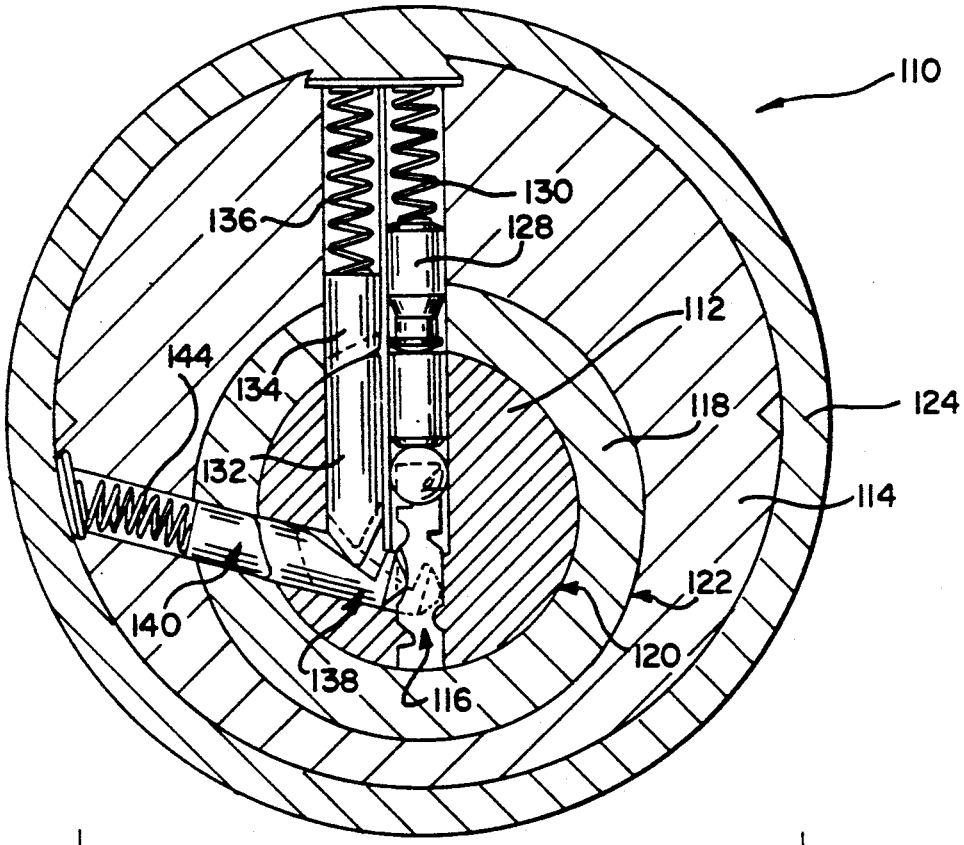
FIG. 3 is a front view of another preferred embodiment of the cylinder lock of the present invention including a master ring.

In another preferred embodiment illustrated in FIG. 3, a lock 110 includes a master ring 118. The master ring configuration permits the lock 110 to be opened with both a correct key for the particular lock 110 and a master key for several locks. In this embodiment, in addition to the tumblers which have been described above which respect to the configuration of FIG. 1, additional sets of tumblers are included which cooperate with the master ring and key to turn the core 112 and master ring 118.

The configuration of these additional tumblers is similar to the configuration of the tumblers described above. Specifically, a conventional set of tumbler segments 126, 128 and a first spring 130 are used to cooperate with the top bitted portion of the key. A second set of chisel tumblers 132, driver tumblers 134 and springs 136 cooperate with an additional set of side tumblers 138, driver tumblers 140 and springs 144 to move the chisel tumblers 132 between the locked and unlocked positions. The side tumblers 138 to cooperate with a dimple on one of the sides or profiles of the key to unlock the master ring 118. Preferably in this embodiment, a hardened carbon steel ring (not shown), such as one having a Rockwell hardness factor of 60, is disposed between the cylindrically shaped master ring 118 and the inner surface of the housing 114. This hardened carbon steel ring provides security against drilling.

Figure 4:
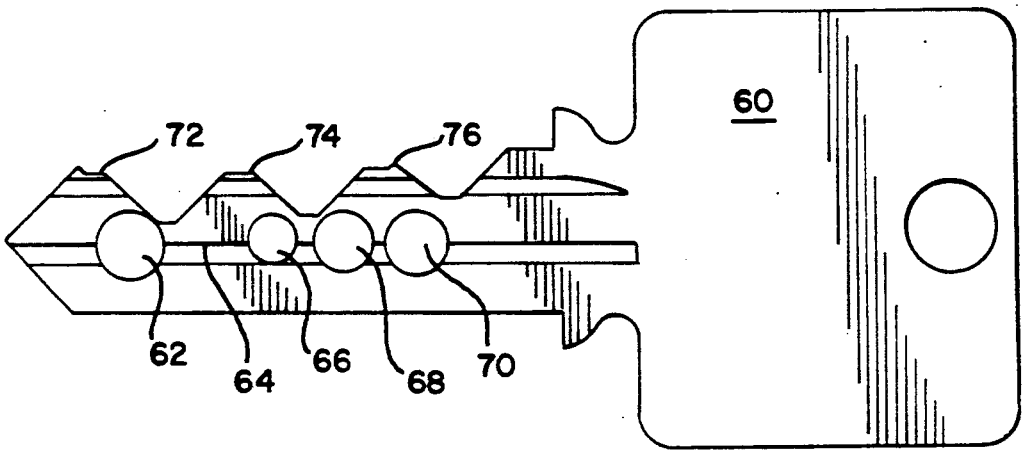
FIG. 4 illustrates a preferred embodiment of a key including vertical key cuts and dimple side cuts for use in the cylinder lock of the present invention.

FIG. 4 illustrates a preferred embodiment of a key 60 which may be used with the lock 10, 110 of the present invention. The key 60 includes a bitted section which includes a plurality of bits 72–76 having different heights. The bitted section cooperates with the conventional tumblers in a manner known in the art to move the conventional tumblers to the shear line. The key 60 further includes a plurality of dimples which are disposed on the profile of the key 60. The dimples are configured to move the side tumblers 38, 138 to the desired position to unlock the lock 10, 110.

The dimples may be of varying depth, such as depths having a range of from 0 to 0.085" and may be disposed in any suitable configuration along the profile of the key 60. In a preferred embodiment, the dimples are aligned on the side of the key along a single line on points 62–70. The distance between the points 62–70 will, of course, depend on the size of the tumblers 38, 138. A distance of approximately 0.25" between each point 62–70 is suitable for tumblers having the dimensions of the exemplary embodiment given above.

The lock of the present invention thus provides a lock having high security features. This lock may be used in any high security area such as schools, office buildings or prisons. The high security design of the lock includes a dual tumbler concept wherein a first tumbler controls the movement of a second tumbler which is inaccessible from the keyway. When the correct key with the correct dimple cut is inserted into the lock, the side tumbler is raised to the key cylinder shear line and the engaging chisel tumbler is lowered by the movement of the side tumbler to the shear line. Since in order to open the lock, one of the tumblers must be lowered to the shear line while a second tumbler must be raised to the shear line, the lock resists conventional tensioning techniques to pick the lock. In fact, with the arrangement of the present invention, tensioning techniques actually hold some of the tumblers in a position across the shear line preventing the cylinder from being rotated.

For example, if a tension tool is used to apply pressure on the key cylinder core while the pin tumbler are raised with a lock pick until all of the tumblers are lifted over the shear line and held in that position with the tension tool, the vertical chisel tumblers are trapped across the shear line. The vertical tumblers cannot be moved down across the shear line because there is no access to these tumblers. The only manner to get the chisel tumblers to drop is to release the pressure from the tension tool. However, when the pressure from the tool is released, all of the other conventional tumblers that were raised to the shear line will drop back to the original position thus requiring the process to be started again.

Further, since the key includes both types of key cuts (conventional vertical key cuts and dimple type cuts), impressioning of the cylinder lock key is virtually impossible. The combination of the vertical cuts and dimple cuts also substantially increases the number of combinations which are possible for a lock.

The foregoing description of the preferred embodiments of the invention has been presented for purposes of illustration and description. They are not intended to be exhaustive or to limit the invention to the precise forms disclosed, and obviously many modifications and variations are possible in light of the above teachings. The embodiments were chosen and described in order to best explain the principles of the invention and its practical applications to thereby enable others skilled in the art to best utilize the invention in various embodiments and with various modifications as are suited to the particular use contemplated. It is intended that the scope of the invention be defined by the following claims, including all equivalents.

I claim:

1. A cylinder lock including a keyway for receiving a key, the lock having a normally locked position and an open position when a correct key is inserted into the keyway, the cylindrical lock comprising:

a cylinder housing including a first aperture and a second aperture;

a core rotatably mounted in the housing thereby defining a shear line between the outer surface of the core and the inner surface of the housing, the core including a first aperture and a second aperture;

a first tumbler slidably disposed in the first apertures of the core and housing;

means for positioning the first tumbler such that i) when the lock is in the locked position, the first tumbler extends across the shear line into the first apertures of the core and housing, and ii) when the lock is in the open position, the first tumbler is urged completely into the core below the shear line;

a second tumbler slidably disposed in the second apertures of the core and housing;

means for positioning the second tumbler such that i) when the lock is in the locked position, the second tumbler extends across the shear line into the second apertures of the core and housing, and ii) when the lock is in the open position, the second tumbler is urged completely into the housing above the shear line;

the first apertures in the core and housing being disposed and the first tumbler being configured such that the first tumbler is in a substantially vertical position in a plane parallel to the plane of the keyway, and such that the first tumbler is inaccessible directly from the keyway when the lock is in the locked position;

the first and second tumblers and the first and second apertures configured such that when the lock is in the locked position, upon relative movement between the core and the housing, the outer surfaces of said first and second tumblers engage the surfaces of said first and second apertures, respectively, and such that the engaging surfaces restrain radial movement of the first and second tumblers.

2. The cylinder lock of claim 1 wherein the means for positioning the first tumbler includes a third tumbler slidably disposed in a third aperture in the core and engaging the first tumbler at an engaging section, the third tumbler normally extending into the keyway when the lock is in the locked position, wherein the first and third tumblers include cooperating surfaces at the engaging section such that i) when the lock is in the locked position, the third tumbler holds the second tumbler across the shear line and ii) when the correct key is inserted into the keyway, the third tumbler is directed out of the keyway and positions the first tumbler below the shear line.

3. The cylinder lock of claim 1 wherein the first and second tumblers comprise cylindrically shaped tumblers and the first and second apertures of the housing and the first and second apertures of the core comprise cylindrically shaped bores.

4. The cylinder lock of claim 2 wherein the second tumbler cooperates with a bitted section on the top portion of the correct key and wherein the third tumbler is disposed at an oblique angle from the first tumbler and cooperates with a predetermined configuration on a profile of the correct key to place the lock in the open position.

5. The cylinder lock of claim 4 wherein the third tumbler cooperates with a dimple on the profile of the key.

6. The cylinder lock of claim 4 wherein the first tumbler is disposed in a plane parallel to the plane which includes the longitudinal axis of the second tumbler.

7. The cylinder lock of claim 6 further including biasing means for positioning the third tumbler in the locked position when the correct key is not inserted.

8. A cylinder lock having a normally locked position and an unlocked position, the lock when in a locked position comprising:

a cylindrical housing including at least two apertures in a first plane defining a first set of apertures, and at least one aperture in a second plane;

a core rotatably mounted in the housing thereby defining a shear line between the outer surface of the core and the inner surface of the housing, the core including a keyway, at least two apertures in a first plane defining a first set of apertures, and at least one aperture in a second plane which includes the keyway, the first set of apertures of the core aligning with the first set of apertures of the housing and the at least one aperture of the core in the second plane aligning with the at least one aperture of the housing in the second plane;

each of the tumblers in said first set of tumblers being slidably disposed in a respective one of the first set of apertures of the core and housing, each of the tumblers in the first set of tumblers including two tumbler segments engaging at a first tumbler separation surface, the separation surface of at least two tumblers in the first set of tumblers having the respective separation surface disposed radially outward of the shear line such that a first segment of the first tumbler crosses the shear line, the separation surface of one of the tumblers in the first set of tumblers having its separation surface disposed at a different radial position than the separation surface of the other tumbler in the first set;

a second tumbler slidably disposed in the apertures in the second plane of the core and housing, the second tumbler including two tumbler segments engaging at a second tumbler separation surface, the second tumbler separation surface disposed radially inward of the shear line such that a first segment of the second tumbler crosses the shear line; and the surfaces of the tumbler segments of the first set of tumblers and the tumbler segments of the second tumbler being configured such that when the lock is in the locked position, each resists movement in a radial direction upon relative displacement of the core and housing.

9. The cylinder lock of claim 8 wherein the separation surfaces of the first and second tumblers are aligned with the shear line when the lock is in the unlocked position and further comprising:

means for positioning each of the tumblers in the first set of tumblers in the unlocked position when a correct key is inserted into the lock; and means for positioning the second tumbler in the unlocked position when a correct key is inserted into the lock.

10. The cylinder lock of claim 9 wherein the means for positioning the tumblers in the first set of tumblers includes a third tumbler for each respective tumbler in the first set of tumblers disposed in a third tumbler aperture in the core, each of the tumblers in the first set of tumblers engaging a respective third tumbler at an engaging section, wherein each of the tumblers in the first set of tumblers and each respective third tumbler include cooperating surfaces at the engaging section such that i) when the lock is it the locked position, the third tumblers hold the first segment of the respective first tumbler across the shear line, and ii) when the lock is in the unlocked position, the respective first tumbler is positioned in the unlocked position.

11. The cylinder lock of claim 9 wherein the first set of tumblers and the second tumbler comprise cylindrically shaped tumblers and the apertures in the first set of apertures and the aperture in the second plane of the housing, and the apertures in the first set of apertures and the aperture in the second plane of the core comprise cylindrically shaped bores.

12. The cylinder lock of claim 10 wherein the first set of tumblers and the second tumblers comprise cylindrically shaped tumblers and the apertures in the first set of apertures and the aperture in the second plane of the housing, and the apertures in the first set of apertures and the aperture in the second plane of the core comprise cylindrically shaped bores.

13. The cylinder lock of claim 12 wherein the bores in the first set of bores are disposed and the tumblers in the first set of tumblers are configured such that the tumblers in the first set of tumblers are not directly accessible from the keyway when the lock is in the locked position.

14. The cylinder lock of claim 12 wherein the second tumbler cooperates with a bitted section on the top portion of a correct key and wherein each of the third tumblers is disposed at an oblique angle from the first set of tumblers and cooperates with a predetermined configuration on the profile of the correct key to position the lock in the open position.

15. The cylinder lock of claim 14 wherein each of the third tumblers cooperates with a respective dimple on the profile of the correct key.

16. The cylinder lock of claim 10 wherein the tumblers in the first set of tumblers are disposed in a plane parallel to the plane which includes the second tumblers.

17. A cylinder lock including a keyway for receiving a key, the lock having a normally locked position and an open position when a correct key is inserted into the keyway, the cylindrical lock comprising:

a cylindrical housing including a first aperture and a second aperture;

a core rotatably mounted in the housing thereby defining a shear line between the outer surface of the core and the inner surface of the housing, the core including a first aperture and a second aperture;

a first tumbler slidably disposed in the first apertures of the core and housing;

means for positioning the first tumbler such that i) when the lock is in the locked position, the first tumbler extends across the shear line into the first apertures of the core and housing, and ii) when the lock is in the open position, the first tumbler is urged completely into the core below the shear line;

a second tumbler slidably disposed in the second apertures of the core and housing;

a third tumbler slidably disposed in a third aperture in the core and engaging the first tumbler at an engaging section, the third tumbler normally extending into the keyway when the lock is in the locked position, wherein the first and third tumblers include cooperating surfaces at the engaging section such that i) when the lock is in the locked position, the third tumbler holds the second tumbler across the shear line and into the second apertures of the core and housing ii) when the correct key is inserted into the keyway, the third tumbler is directed out of the keyway, the first tumbler is positioned below the shear line, and the second tumbler is urged completely into the housing above the shear line;

the first apertures in the core and housing being disposed and the first tumbler being configured such that the first tumbler is disposed in a substantially vertical position in the plane of the keyway, and such that the first tumbler is inaccessible directly from the keyway when the lock is in the locked position;

the first and second tumblers configured such that when the lock is in the locked position the tumblers resist radial movement upon relative movement between the core and the housing; and a key for the cylindrical lock having a top edge and sides, the top edge of the key having bits which cooperate with the second tumbler to open the lock, and one of the sides of the key having dimples which cooperate with the third tumblers to open the lock.

18. The cylindrical lock of claim 17 further comprising a plurality of first and third tumblers thereby defining a first set of tumblers and a third set of tumblers and wherein the key includes a second dimple which cooperates with the third tumbler in the second set, the first dimple having a different depth than the second dimple.

19. The cylinder lock of claim 17 wherein the first tumbler is disposed in a plane parallel to the plane which includes the longitudinal axis of the second tumbler.

20. A cylinder lock including a keyway for receiving a key, the lock having a normally locked position and an open position when a correct key is inserted into the keyway, the cylindrical lock comprising:

a cylindrical housing including a first aperture and a second aperture;

a core rotatably mounted in the housing thereby defining a shear line between the outer surface of the core and the inner surface of the housing, the core including a first aperture and a second aperture;

a first tumbler slidably disposed in the first apertures of the core and housing;

means for positioning the first tumbler such that i) when the lock is in the locked position, the first tumbler extends across the shear line into the first apertures of the core and housing, and ii) when the lock is in the open position, the first tumbler is urged completely into the core below the shear line;

a second tumbler slidably disposed in the second apertures of the core and housing;

a third tumbler slidably disposed in a third aperture in the core and engaging the first tumbler at an engaging section, the third tumbler normally extending into the keyway when the lock is in the locked position, wherein the first and third tumblers include cooperating surfaces at the engaging section such that i) when the lock is in the locked position, the third tumbler holds the second tumbler across the shear line and into the second apertures of the core and housing ii) when the correct key is inserted into the keyway, the third tumbler is directed out of the keyway, the first tumbler is positioned below the shear line, and the second tumbler is urged completely into the housing above the shear line;

the first apertures in the core and housing being disposed and the first tumbler being configured such that the first tumbler is disposed in a substantially vertical position in the plane of the keyway, and such that the first tumbler is inaccessible directly from the keyway when the lock is in the locked position;

the first and second tumblers configured such that when the lock is in the locked position the tumblers resist radial movement upon relative movement between the core and the housing.

21. The cylinder lock of claim 20 wherein the first tumbler is disposed in a plane parallel to the plane which includes the longitudinal axis of the second tumbler.

22. A cylinder lock including a keyway for receiving a key, the lock having a normally locked position and an open position when a correct key is inserted into the keyway, the cylindrical lock comprising:

a cylindrical housing including a first aperture and a second aperture;

a core rotatably mounted in the housing thereby defining a shear line between the outer surface of the core and the inner surface of the housing, the core including a first aperture and a second aperture;

a first tumbler slidably disposed in the first apertures of the core and housing;

means for positioning the first tumbler such that i) when the lock is in the locked position, the first tumbler extends across the shear line into the first apertures of the core and housing, and ii) when the lock is in the open position, the first tumbler is urged completely into the core below the shear line;

a second tumbler slidably disposed in the second apertures of the core and housing;

a third tumbler slidably disposed in a third aperture in the core and engaging the first tumbler at an engaging section, the third tumbler normally extending into the keyway when the lock is in the locked position, wherein the first and third tumblers include cooperating surfaces at the engaging section such that i) when the lock is in the locked position, the third tumbler holds the second tumbler across the shear line and into the second apertures of the core and housing ii) when the correct key is inserted into the keyway, the third tumbler is directed out of the keyway, the first tumbler is positioned below the shear line, and the second tumbler is urged completely into the housing above the shear line;

the first apertures in the core and housing being disposed and the first tumbler being configured such that the first tumbler is disposed in a plane substantially parallel to the plane which includes the longitudinal axis of the second tumbler, and such that the first tumbler is inaccessible directly from the keyway when the lock is in the locked position;

the first and second tumblers configured such that when the lock is in the locked position the tumblers resist radial movement upon relative movement between the core and the housing; and a key for the cylindrical lock having a top edge and sides, the top edge of the key having bits which cooperate with the second tumbler to open the lock, and one of the sides of the key having dimples which cooperate with the third tumblers to open the lock.

23. A cylinder lock including a keyway for receiving a key, the lock having a normally locked position and an open position when a correct key is inserted into the keyway, the cylindrical lock comprising:

a cylindrical housing including a first aperture and a second aperture;

a core rotatably mounted in the housing thereby defining a shear line between the outer surface of the core and the inner surface of the housing, the core including a first aperture and a second aperture;

a first tumbler slidably disposed in the first apertures of the core and housing;

means for positioning the first tumbler such that i) when the lock is in the locked position, the first tumbler extends across the shear line into the first apertures of the core and housing, and ii) when the lock is in the open position, the first tumbler is urged completely into the core below the shear line;

a second tumbler slidably disposed in the second apertures of the core and housing;

a third tumbler slidably disposed in a third aperture in the core and engaging the first tumbler at an engaging section, the third tumbler normally extending into the keyway when the lock is in the locked position, wherein the first and third tumblers include cooperating surfaces at the engaging section such that i) when the lock is in the locked position, the third tumbler holds the second tumbler across the shear line and into the second apertures of the core and housing ii) when the correct key is inserted into the keyway, the third tumbler is directed out of the keyway, the first tumbler is positioned below the shear line, and the second tumbler is urged completely into the housing above the shear line;

the first apertures in the core and housing being disposed and the first tumbler being configured such that the first tumbler is disposed in a plane substantially parallel to the plane which includes the longitudinal axis of the second tumbler, and such that the first tumbler is inaccessible directly from the keyway when the lock is in the locked position;

the first and second tumblers configured such that when the lock is in the locked position the tumblers resist radial movement upon relative movement between the core and the housing.

* * * * *